US010940507B2

(12) United States Patent
McLaughlin

(10) Patent No.: US 10,940,507 B2
(45) Date of Patent: Mar. 9, 2021

(54) MOBILE MATERIAL SIFTER

(71) Applicant: Martin Shaun McLaughlin, Braintree, MA (US)

(72) Inventor: Martin Shaun McLaughlin, Braintree, MA (US)

( * ) Notice: Subject to any disclaimer, the term of this patent is extended or adjusted under 35 U.S.C. 154(b) by 111 days.

(21) Appl. No.: 16/241,242

(22) Filed: Jan. 7, 2019

(65) Prior Publication Data

US 2020/0215575 A1 Jul. 9, 2020

(51) Int. Cl.

| | |
|---|---|
| ***B07B 1/34*** | (2006.01) |
| ***B07B 1/00*** | (2006.01) |
| ***B07B 1/42*** | (2006.01) |

(52) U.S. Cl.

CPC ..... *B07B 1/005* (2013.01); *B07B 1/34* (2013.01); *B07B 1/42* (2013.01)

(58) Field of Classification Search

CPC ..... B07B 1/005; B07B 1/34; B07B 1/42
See application file for complete search history.

(56) References Cited

U.S. PATENT DOCUMENTS 2,133,195 A * 10/1938 Howard ..... B60T 11/107 188/112 R
2,142,794 A 1/1939 Matthews
3,439,806 A 4/1969 Kass et al.
3,596,764 A 8/1971 Smith
3,765,490 A 10/1973 Logue
4,197,194 A * 4/1980 Read ..... B07B 1/284 209/325
4,237,000 A * 12/1980 Read ..... B07B 1/4672 209/319
4,303,507 A 12/1981 Smith
(Continued)

FOREIGN PATENT DOCUMENTS

GB 2 351 247 A 12/2000
WO WO 92/06250 4/1992
(Continued)

OTHER PUBLICATIONS

AdjustABucket, "Excavator Sieve—Adjustable Excavator Attachments;" Retrieved from www.adjustabucket.com/au/excavator-sieve; Mar. 26, 2018; 2 Pages.
(Continued)

*Primary Examiner* — Patrick H Mackey
(74) *Attorney, Agent, or Firm* — Daly Crowley Mofford & Durkee, LLP

(57) ABSTRACT

The concepts, systems and methods described herein are directed towards a device sifting soils. The device is provided to including: a frame having open areas at top, bottom, and rear side; a plurality of wheels coupled to the frame; a first screen coupled to the frame, wherein the first screen has a grid to receive material for sifting; a vibrating unit coupled to the first screen, wherein the vibrating unit is configured to vibrate the first screen such that small objects and dirt in the material pass through the screen and the open areas of the frame and the large objects in the material fall off from the first screen at a first side of the sifting device; and a tow hitch to be coupled to a vehicle, the vehicle pulling the sifting device using the tow hitch.

19 Claims, 7 Drawing Sheets

(56) References Cited

U.S. PATENT DOCUMENTS

| | | | | |
|---|---|---|---|---|
| 4,923,597 | A * | 5/1990 | Anderson | B07B 1/005 209/315 |
| 5,082,555 | A | 1/1992 | Read | |
| 5,241,764 | A | 9/1993 | Modig | |
| 5,398,430 | A | 3/1995 | Scott et al. | |
| 5,743,030 | A | 4/1998 | Sirr | |
| 5,842,578 | A * | 12/1998 | Cordeiro | B07B 1/005 209/420 |
| 5,899,340 | A * | 5/1999 | MacNaughton | B07B 1/005 209/325 |
| 6,135,290 | A | 10/2000 | Heiple | |
| 6,138,837 | A | 10/2000 | Santa Cruz et al. | |
| 6,988,624 | B2 * | 1/2006 | MacNaughton | B07B 1/005 209/315 |
| 7,156,236 | B2 * | 1/2007 | Geraghty | E01H 12/00 171/63 |
| 7,204,046 | B2 | 4/2007 | Currey | |
| 7,380,674 | B2 | 6/2008 | Vaine | |
| 8,464,874 | B2 | 6/2013 | Whitley et al. | |
| 8,678,195 | B2 | 3/2014 | Azzolin et al. | |
| 8,893,409 | B1 | 11/2014 | Rossi, Jr. | |
| 2007/0227750 | A1 * | 10/2007 | Ari | E01H 12/00 171/111 |
| 2008/0310916 | A1 | 12/2008 | Belanger | |
| 2012/0103876 | A1 | 5/2012 | Allaire | |
| 2015/0315763 | A1 | 11/2015 | Brown | |
| 2017/0314228 | A1 | 11/2017 | Sirr | |

FOREIGN PATENT DOCUMENTS

| | | | |
|---|---|---|---|
| WO | WO 01/73214 | A1 | 10/2001 |
| WO | WO 2017/118453 | A1 | 7/2017 |

OTHER PUBLICATIONS

PCT International Search Report and Written Opinion dated Apr. 28, 2020 for International Application No. PCT/US2019/068873; 14 Pages.

* cited by examiner

MOBILE MATERIAL SIFTER

BACKGROUND

As is known in the art, trenches containing a pipeline or cable should be backfilled with materials that do not harm the pipeline or cable. For example, fiber optical cable is vulnerable to damages from hard stones, and it is important to prevent hard objects, such as large rocks, from damaging the cable. To achieve this goal, relatively softer material, such as sand/small gravel/dirt, may be used to backfill the trenches. However, it may be costly to obtain such materials if the source of the sand/dirt/small gravel is far from the trenches. Another approach is to use excavated material from surrounding areas, but it is necessary to screen the material to get rid of any hard objects that can damage the pipeline or cable.

SUMMARY

In accordance with the concepts, techniques and systems described herein is an efficient method for separating large objects from material that can be used to backfill trenches.

According to one illustrative embodiment, a sifting device may include: a frame having open areas at top, bottom, and rear side; a plurality of wheels coupled to the frame; a first screen coupled to the frame, wherein the first screen has a grid to receive material for sifting; a vibrating unit coupled to the first screen, wherein the vibrating unit is configured to vibrate the first screen such that small objects and dirt in the material pass through the screen and the open areas of the frame and the large objects in the material fall off from the first screen at a first side of the sifting device; and a tow hitch to be coupled to a vehicle, the vehicle pulling the sifting device using the tow hitch.

In one aspect, the sifting device may further include a guide coupled to the first screen, wherein the guide prevents the material from falling off from the first screen.

In one aspect, the sifting device may further include a second screen disposed on the first screen, wherein the second screen allows fine objects to pass through the second screen onto a sand chute such that the fine objects fall off from the sand chute to a second side of the sifting device. Herein, the sand chute may be coupled to the frame with an angle at an opposite side of the first screen.

In one aspect, the vibrating unit may be driven by a hydraulic pump. In another aspect, the vibrating unit may be driven by a belt connected to a pulley of a vehicle.

In one aspect, the sifting device may further include a braking unit coupled to the tow hitch such that the braking unit prevents rotation of at least one of the plurality of the wheels when the sifting device is not pulled by a vehicle and the braking unit releases the at least one of the plurality of the wheels when the sifting device is pulled by the vehicle.

In one aspect, the first screen may be coupled to the frame at an angle.

In one aspect, the first screen may be movable such that the larger objects fall off from the first screen at a second side of the sifting device.

In one aspect, the sifting device may drop the small objects and dirt onto the ground through the open area at the rear side as the sifting device is pulled by a vehicle.

According to another illustrative embodiment, a method for separating large objects and small objects may include: pouring material over a first screen coupled to a frame, wherein the first screen has a grid and the first screen and the frame form a sifting device; and vibrating the first screen with a vibration unit such that small objects and dirt pass through the first screen and opens area of the frame and larger objects fall off from the first screen at a first side of the sifting device.

In one aspect, the method may further include pulling the sifting device by a vehicle such that the small objects and dirt drop to different regions through an open area at the rear side as the sifting device moves.

In one aspect, the method may further include preventing the material from falling off from the first screen with a guide, wherein the guide is coupled to the first screen.

In one aspect, the method may further include separating fine objects using a second screen, wherein the second screen allows fine objects to pass through the second screen onto a sand chute such that the fine objects fall off from the sand chute to a second side of the sifting device.

In one aspect, the method may further include moving the first screen such that larger objects fall off from the first screen at a second side of the sifting device.

The details of one or more embodiments of the disclosure are outlined in the accompanying drawings and the description below. Other features, objects, and advantages of the disclosure will be apparent from the description and drawings, and from the claims.

BRIEF DESCRIPTION OF THE DRAWINGS

The foregoing features may be more fully understood from the following description of the drawings in which.

DETAILED DESCRIPTION

Relative descriptions herein, such as left, right, up, and down, are with reference to the figures, are merely relative and not meant in a limiting sense. Unless otherwise specified, the illustrated embodiments may be understood as providing illustrative features of varying detail of certain embodiments, and therefore, unless otherwise specified, features, components, modules, elements, and/or aspects of the illustrations can be otherwise combined, interconnected, sequenced, separated, interchanged, positioned, and/or rearranged without materially departing from the disclosed concepts, systems, or methods. Additionally, the shapes and sizes of components are intended to be only illustrative and unless otherwise specified, can be altered without materially affecting or limiting the scope of the concepts sought to be protected herein.

Figure 1:
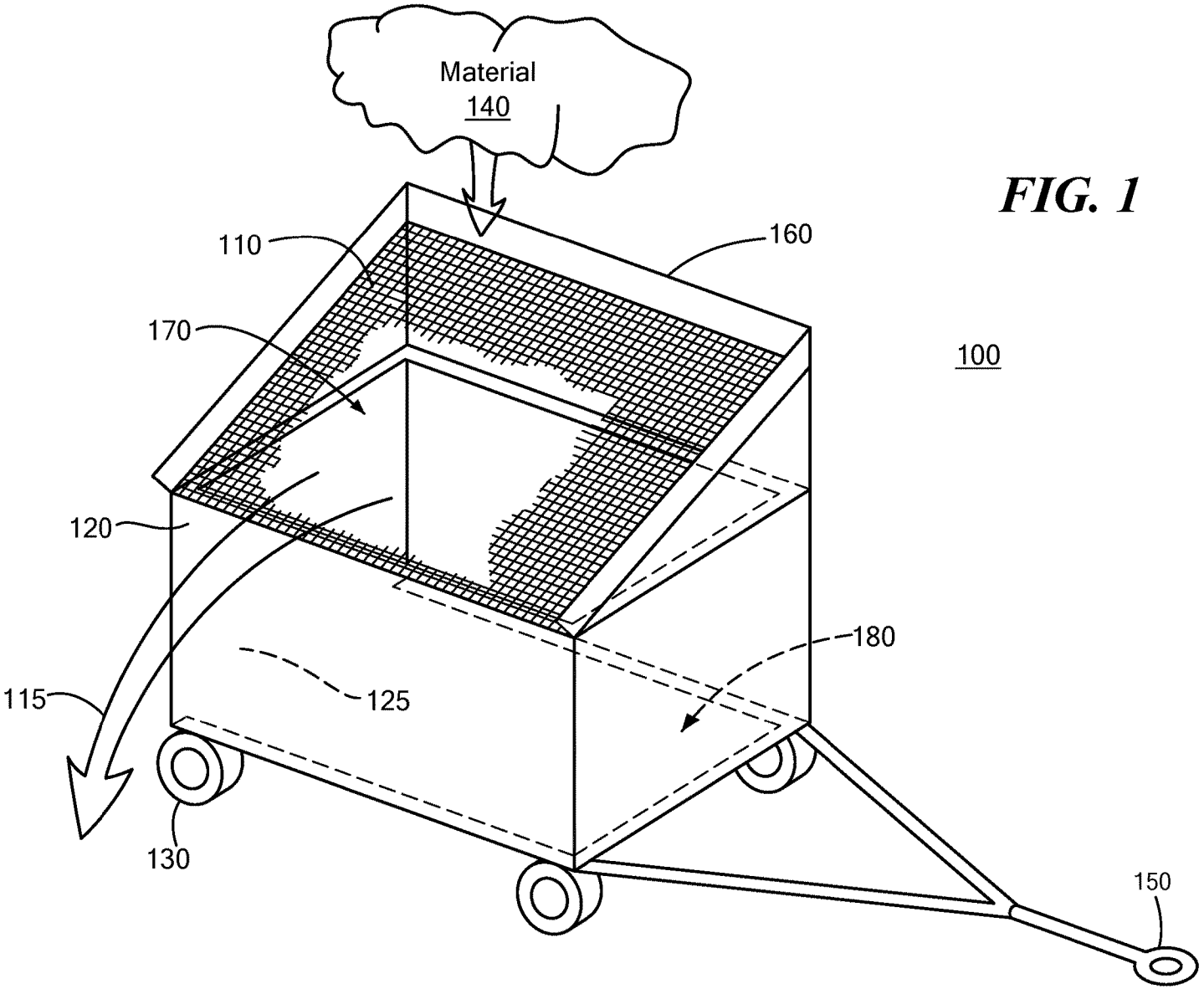
FIG. 1 is a diagram showing a structure of a sifting device according to the concepts described herein.

Referring now to FIG. 1, a diagram showing a sifting device 100 is presented. The sifting device 100 may comprise a first screen 110, a frame 120, a plurality of wheels 130, and a tow hitch 150. Material 140 to be sifted may be poured over the first screen 110. The first screen 110 has a grid structure, such as rectangles, such that the size of apertures created by the grid structure is selected to allow objects having the required size from the material 140 pass through the first screen 110 and drop down to the frame 120. The frame 120 has open areas 170, 180 at top and bottom of the frame 120 such that material that has passed through the first screen 110 fall into the open areas 170 and 180, and as a result, the screened material drops to the ground under the frame 120. Larger objects that cannot pass the first screen 110 may fall off from the first screen 110 in a direction 115 to which the first screen is tilted. The frame 120 may have an open area 125 at the rear side where the sand/dirt/gravel will pass through when the sifting device 100 is pulled forward by a vehicle, which results in leaving the reusable material such as sand/dirt/gravel in an area (for example 270 of FIG. 2B). The sifting device 100 may be connected to a vehicle (for example, 250 of FIG. 2) using the tow hitch 150. As the sifting device 100 is pulled forward by the vehicle 250, the sifted material may fall to different locations on the ground.

In example embodiments, the first screen 110 is coupled to the frame 120 along an edger of the first screen such that the first screen 110 and the top plane of the frame 120 may have an angle of about 22 degrees. However, as can be appreciated by those of ordinary skill in the pertinent art, the first screen and the frame may form an angle with an appropriate degree. In embodiments, the angle of the first screen 110 can be adjusted within some range, such as zero degrees to about sixty degrees. In some embodiments, a guide 160 may be coupled to the first screen 110. The guide 160 may prevent some of the material 140 falling off from the first screen 110, except to the direction 115 to which the first screen is tilted.

Figure 2A:
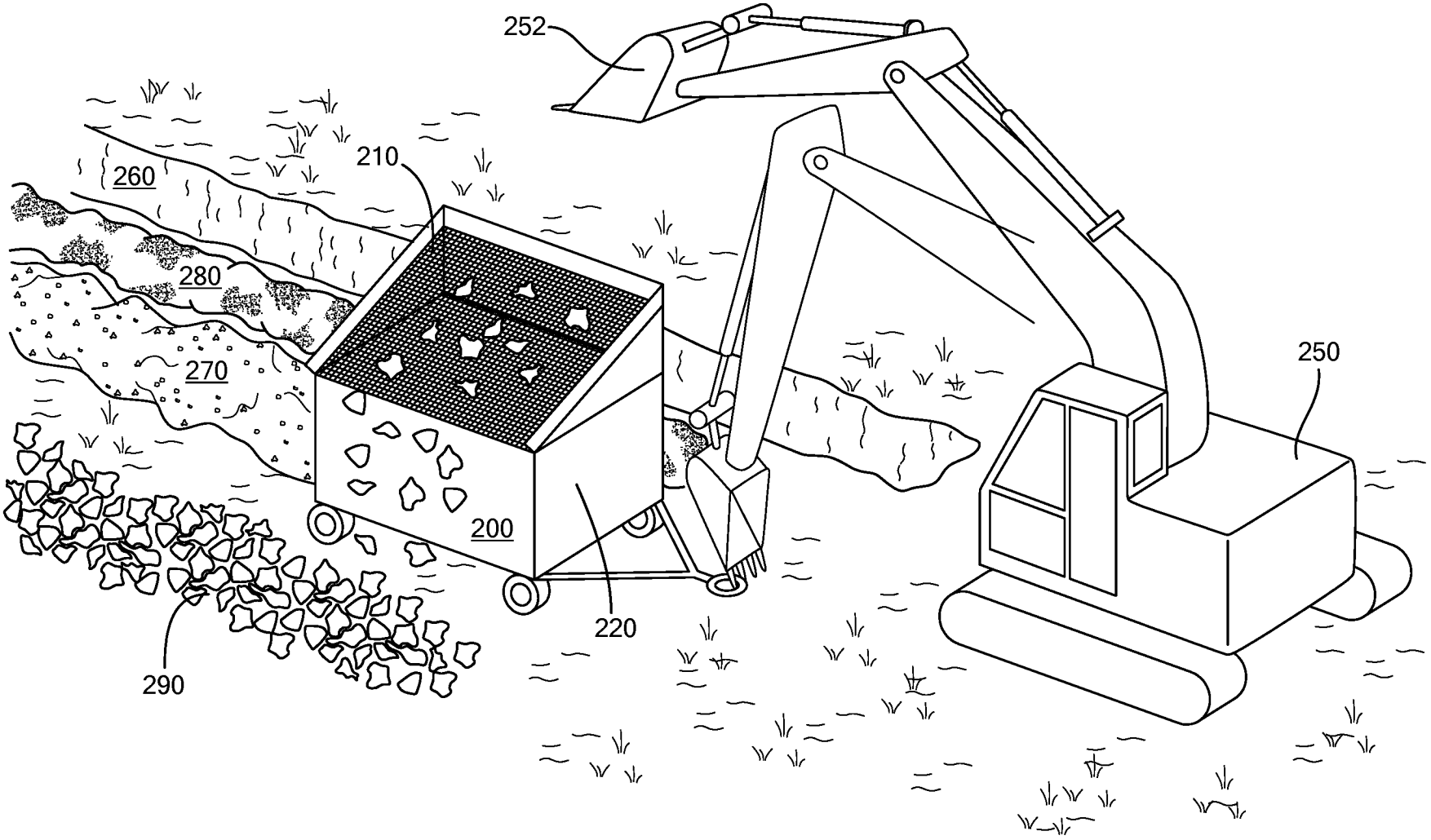
FIGS. 2A-2C are diagrams showing how a sifting device operates according to the concepts described herein.

Referring now to FIG. 2A, a diagram shows how an illustrative sifting device 200 operates. A vehicle 250 (e.g., backhoe) digs a trench 260 and excavates material (i.e., soil) from the trench 260. The material may have objects of different sizes. Reusable material, such as sand/dirt/small gravel, to backfill the trench 260 needs to be separated from large objects that may damage a pipeline or cable in the trench 260. The sifting device 200 may position next to the trench 260 such that a longitudinal axis of the sifting device 200 is parallel with the trench 260. The vehicle 250 may scoop material from the trench 260 using a bucket 252 of the vehicle 250 and drop the material on top of the sifting device 200. Herein, the vehicle 250 may be an excavator, a backhoe, or any equipment that can scoop material from the trench 260 and pour the material on top of the sifting device 200. Then, a screen 210 of the sifting device 200 may allow only reusable material to pass through the screen 210. The reusable material may fall through the screen 210 and open areas (e.g., 170 and 180 in FIG. 1) of frame to underneath 270 of the sifting device 200. Larger objects, such as rocks, that do not go through the screen 210 fall off the screen 210 and will be dropped to a rubble side 290, where the large objects are placed. The reusable material dropped on 270 may be used to backfill the trench 260. For example, a small powered-machine (e.g., skid-steer loader) may push the reusable material on the area 270 where the reusable material is dropped back to the trench 260 to backfill the trench 260.

Figure 2B:
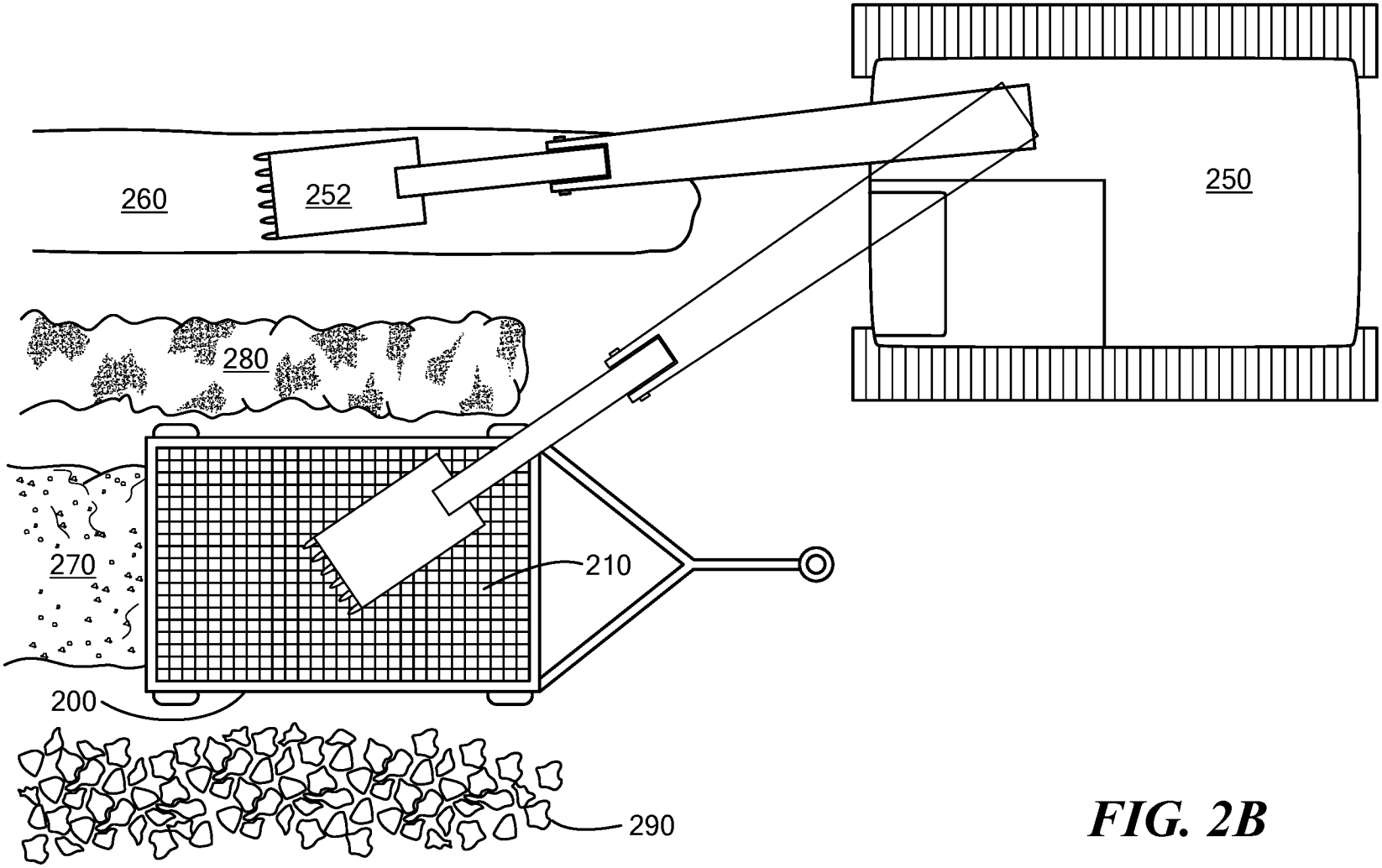
Figure 2C:
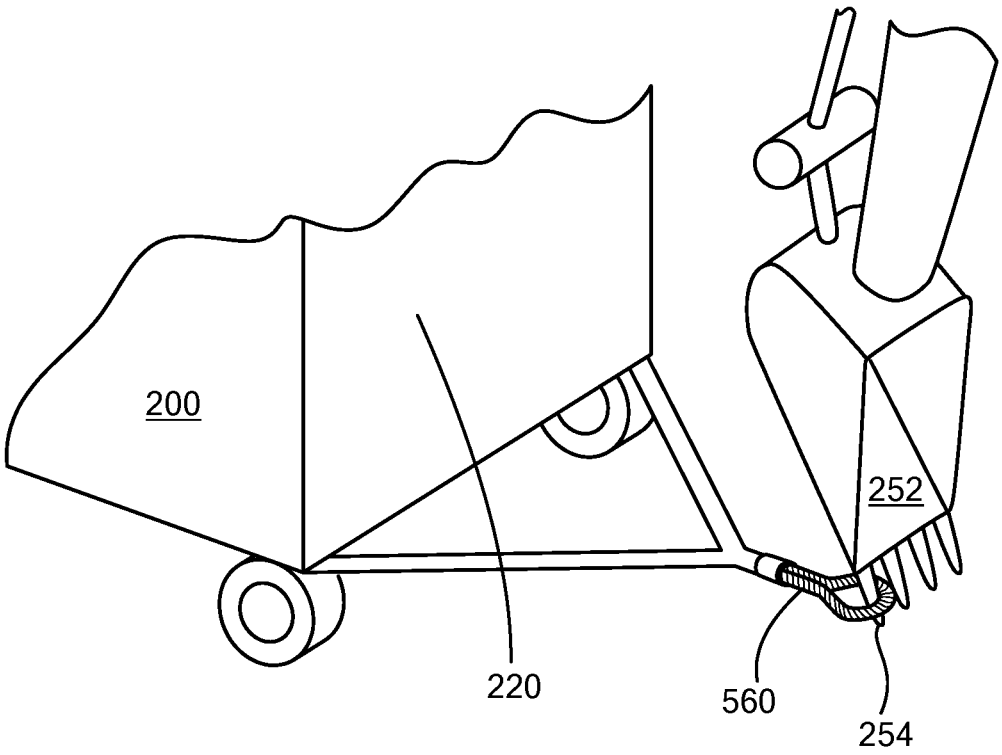

In some embodiments, the sifting device 200 may be pulled by the vehicle 250 via a bucket teeth 254 of the bucket 252 as shown in FIG. 2C. That is, the vehicle operator (not shown) may dig the trench 260, scoop material from the trench 260 and drop the material on top of the sifting device 200, and pull the sifting device 200 using the bucket teeth 254 with a tow hitch (e.g., 560 in FIG. 5C). Alternately, the sifting device 200 may be connected to another vehicle (not shown) via a regular tow-hitch (e.g., 550 in FIG. 5B). The another vehicle may pull the sifting device 200 as parallel to the vehicle 250 as the vehicle 250 moves to dig the trench 260.

In some embodiments, the sifting device 200 may have a second screen (e.g., 330 in FIG. 3) that has smaller grid rectangles than the first screen 210. In some embodiments, the second screen 330 may be located at a front upper area of the first screen 210 covering about one quarter of the first screen 310. In other embodiments, the second screen 330 may be located at other places. As can be appreciated by those of ordinary skill in the pertinent art, the second screen 330 may have a various size and shape based upon the purpose of the sifting device 200. Objects having a fine grade, for example sand only, go through the second screen and fall onto a sand chute 334 and will slide off to the other side 280 of the sifting device 200. Herein, the fine grade objects, such as sand, dropped to the other side 280 may be used to other purposes. For example, the sand may be used pad a soft bottom of the trench 260 where the cable or pipeline will be laid. For example, the sand dropped on side 280 will be shoveled into the trench 260 by laborers before reusable material dropped on 270 is pushed to backfill the trench 260 by a skid-steer loader.

Referring now to FIG. 2B, another diagram from a top view of the sifting device 200 and the vehicle 250 is presented. As described above in conjunction with FIG. 2A, the vehicle 250 may dig a trench 260 and scoop material from the trench 260 using a bucket 252. Then, the vehicle 250 pours the material on top of the sifting device 200. Then, sand/small gravel of the material pass through the screen 210 and drop to the ground 270 underneath of the sifting device 200. The sifting device 200 may be pulled by the vehicle 250 with its bucket 252. Alternately, the sifting device 200 may be pulled by another vehicle (not shown).

Figure 3:
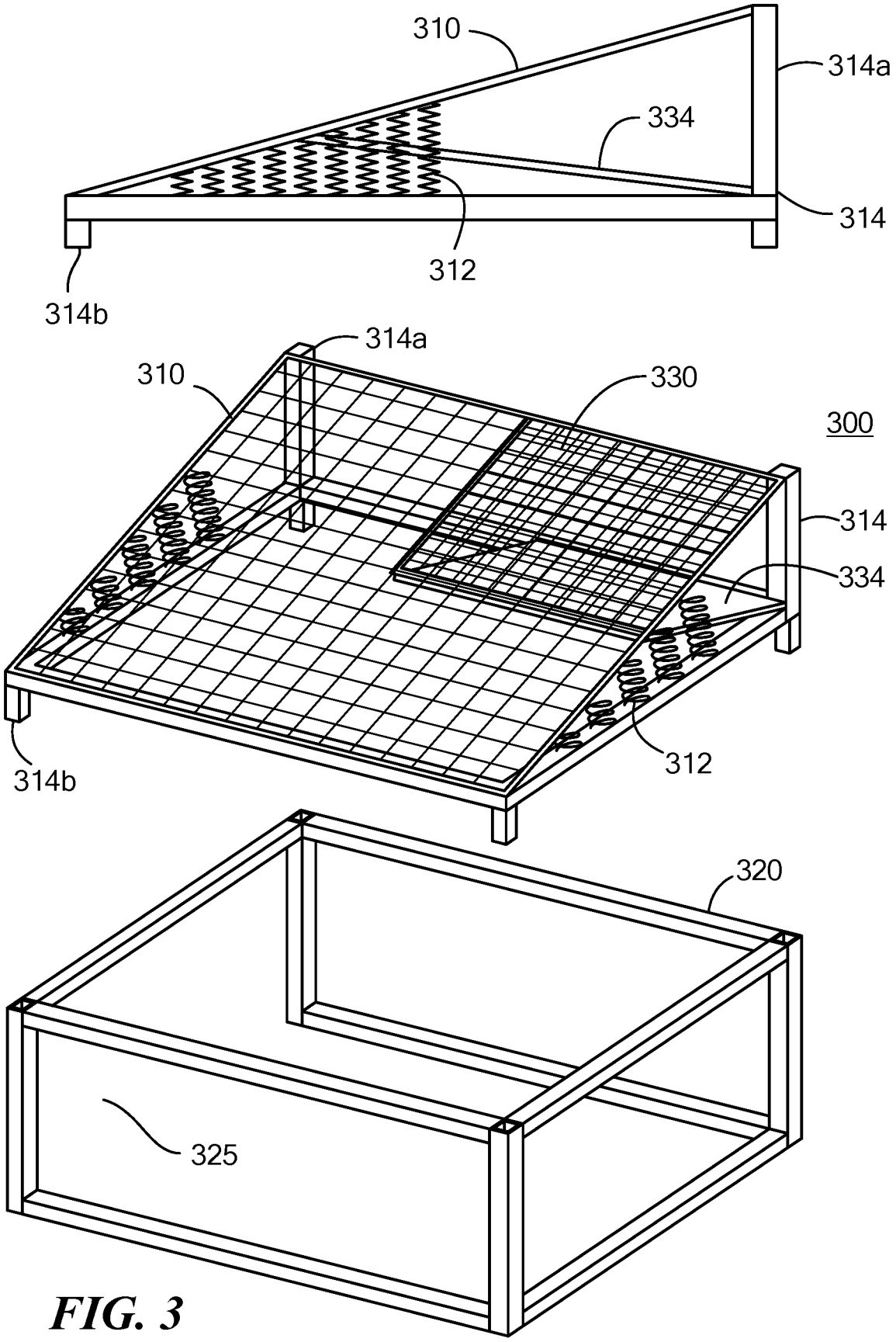
FIG. 3 is a diagram showing a structure of first and second screens and a frame according to the concepts described herein.

Referring now to FIG. 3, an example sifter includes first and second screens 310, 330 and a frame 320 is presented. The frame 320 may be formed by steel bars, steel panels, or any other materials that are suitable to make the frame. The frame 320 should have at least open areas at top and bottom of the frame, so that objects may go through the frame. Furthermore, the rear side 325 of the frame 320 is open such that reusable material drops gradually to the ground when the sifting device is pulled forward by a vehicle (e.g., 250 in FIG. 2A). The first screen 310 is disposed on top of the frame 320. The first screen 310 may have its own frame 314 for support. The direction of the first screen 310 may be changed to have a different direction to be tilted. For example, the first screen 310 may be rotated 180 degrees so that larger objects may fall off the screen to different directions depending on which side of the street is being dug, therefore which side the sifting device is used as a space (e.g., 290 in FIG. 2A) to place larger objects dropped from the first screen 310. In another embodiment, the screen frame 314 may have a mechanism to change heights of individual frames. For example, the heights of frames of 314*a* and 314*b* may be changed so that the screen 310 may be tilted in a different direction. In an embodiment, the first screen has an angle of about 22 degrees. In some embodiments, coil springs 312 may be disposed between the screen 310 and the spring frame 314 in order to allow free movement of the first screen 310 and to reduce impact from material dropped on top of the screen 310. In other embodiments, another suitable method may be used to reduce the impact.

In some embodiments, the second screen 330 may be disposed on a portion of the first screen 310, for example at the upper front end of the first screen 310 as shown in FIG.

3. The second screen 330 may have smaller grid rectangles than the first screen 310. With the second screen 330, fine objects (e.g., sand) fall down onto a sand chute 334. Then, the small objects will be dropped to the other side of the first screen 310 (e.g. 280 in FIG. 2A). The small objects, such as sand, will be used for padding the bottom of a trench. For example, laborers may push the sand from 280 to the trench 260 with shovels.

Figure 4:
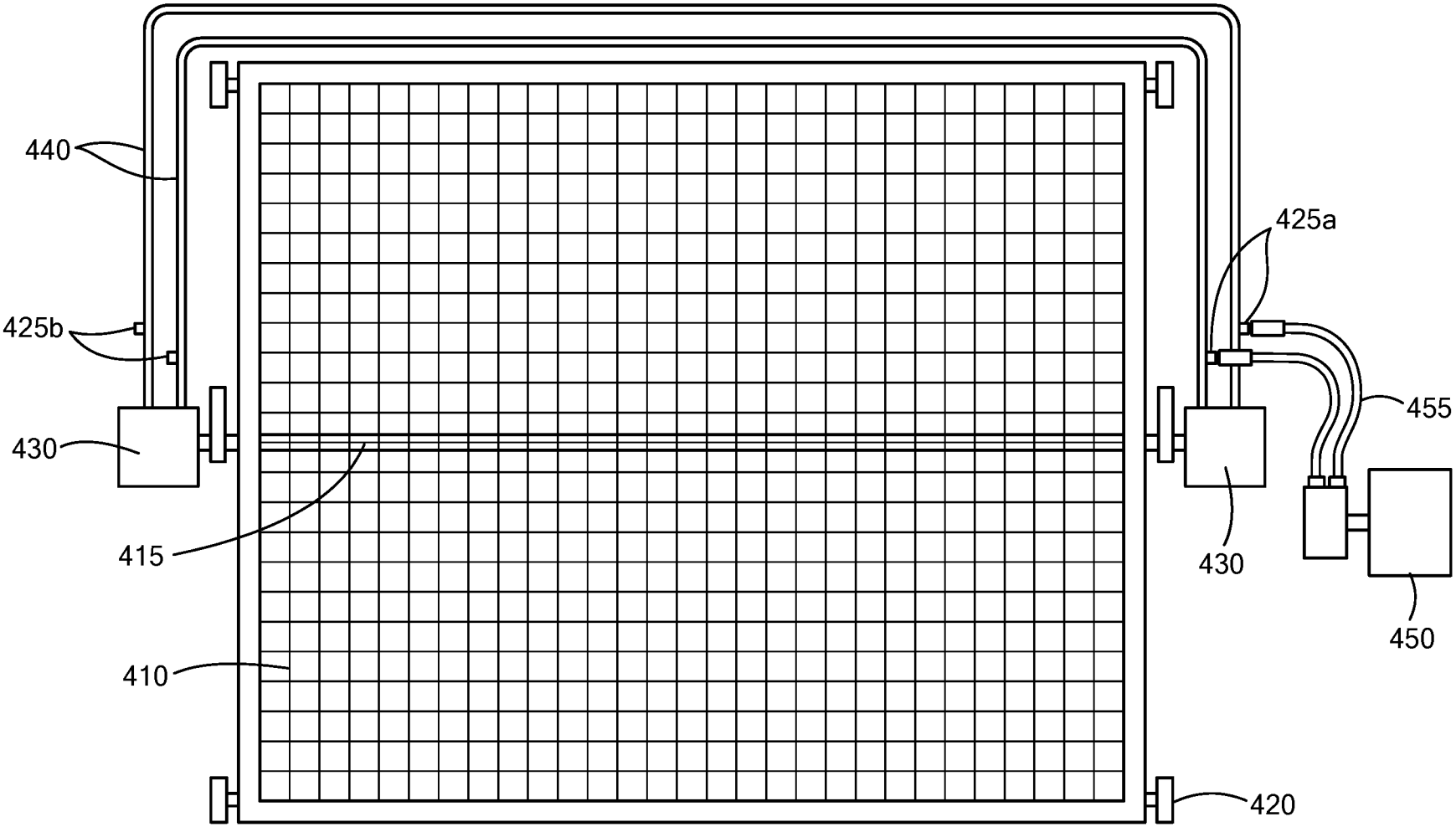
FIG. 4 is a diagram showing a structure of a vibrating unit according to the concepts described herein.

Referring now to FIG. 4, a diagram showing a structure of a vibrating unit is presented. The sifting device (e.g., 100 in FIG. 1) may separate larger objects from small objects using vibration of the screen 410 caused by movement of the sifting device 100 when the sifting device is pulled by a vehicle. Furthermore, the sifting device 100 may include a vibrating unit 430 that is coupled to the screen 410, and small wheels 420 that allow free movement of the screen 410 over the frame (e.g., 314 in FIG. 3). The hydraulic pump 430 may have a drive shaft 415 that connects both sides the vibrating unit 430 to shake both sides at the exact same speed. The vibrating unit 430 may have off-centered weight such that rotating the vibrating unit 430 creates vibration to the first screen 410. In some embodiments, the vibrating unit 430 is run by a hydraulic pump 450 that is attached to a gasoline/diesel engine (not shown) which will be mounted on the front of the sifting device 200. The hydraulic pump 450 may provide power to the vibrating unit 430 via engine hydraulic pipes 455 that are connected to hydraulic pipes 440. The hydraulic pipes 440 may have quick connect pipe couplers 425*a*, 425*b* where the engine hydraulic pipes 455 are connected. When the screen 410 is rotated, the hydraulic pipes 440 may be disconnected at 425*a* from the engine hydraulic pipes 455 and reconnected at quick connect pipe couplers 425*b* at the opposite side once the screen 410 is rotated. In some embodiments, there may be an auxiliary hydraulic line from the vehicle 250 that can connect to an additional quick connect of the hydraulic pipes 440. The vibration caused by the vibration unit 430 may force the larger and small objects to move rapidly and separate from each other. A hydraulic pump may be beneficial because the screen 410 may be vibrated with fewer moving parts (i.e., a hydraulic pump 450). In another embodiment, the vibration unit 430 may be driven by a belt (not shown) that is connected to the gasoline/diesel engine 455 via pulleys of another vehicle.

Figure 5A:
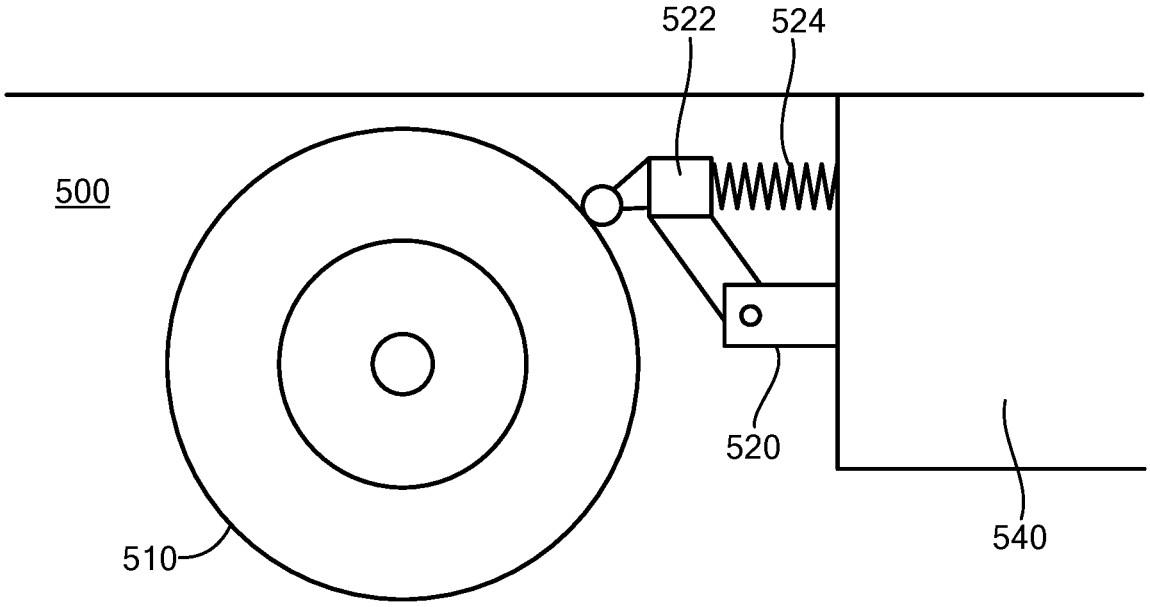
FIGS. 5A-5C are diagrams showing a wheel braking mechanism for a sifting device according to the concepts described herein.
Figure 5B:
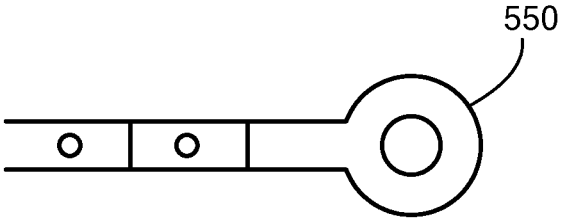
Figure 5C:
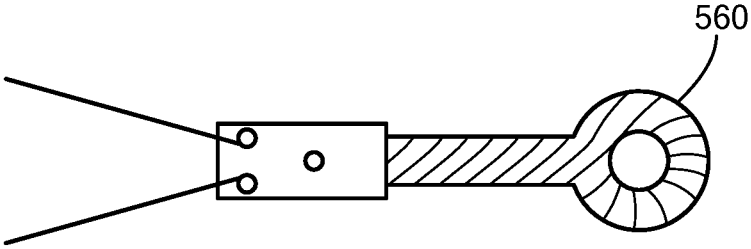

Referring now to FIGS. 5A-5C, diagrams showing a braking mechanism for wheels of a sifting device are presented. For at least one wheel 510 of a plurality of wheels (e.g., 130 in FIG. 1) of a sifting device (e.g., 100 in FIG. 1), a braking mechanism 520 may be applied. The braking mechanism 520 may be deposited on a part 540 of the frame (e.g., 120 in FIG. 1). The one wheel 510 may be a rear side wheel. In some embodiments, the braking mechanism 520 may have a brake 522 that can touch the wheel 510. The brake 522 is coupled to a coil spring 524 that pushes the brake 522 toward the wheel 510 such that the brake 522 prevents the wheel 510 from moving. However, as can be appreciated by those of ordinary skill in the pertinent art, any other suitable braking mechanism may be applied instead of the coil spring 524. The braking mechanism 520 may be connected to a tow hitch 550 in FIG. 5B (or 150 in FIG. 1). The tow hitch 550 may be connected to a vehicle. When the sifting device 100 is pulled forward by the vehicle, a force is applied through the tow hitch 550 to the braking mechanism 520 such that the brake 522 is released from the wheel 510. Accordingly, the sifting device 100 may move freely when the sifting device 100 is pulled by a vehicle. In some embodiments, a wire-rope tow hitch 560 in FIG. 5C may be used. The wire-rope tow hitch 560 may be used when the sifting device 100 is pulled forward by an excavator or backhoe using a bucket teeth 254 as shown in FIG. 2C. When the sifting device 100 is pulled via the bucket teeth 254, there is risk that the bucket teeth may touch other than a hole of the wire-rope tow hitch 560. Furthermore, the sifting device 100 may be pulled not in a straight way, which results in up/down force to be applied to the tow hitch 560. These unexpected movements from the bucket 252 and the bucket teeth 254 may cause damage to a regular tow-hitch 550. Flexibility from the wire-rope tow hitch 560 may prevent damages from using the bucket teeth 254.

Having described preferred embodiments, which serve to illustrate various concepts, structures and techniques, which are the subject of this patent, it will now become apparent that other embodiments incorporating these concepts, structures and techniques may be used. Accordingly, it is submitted that the scope of the patent should not be limited to the described embodiments but rather should be limited only by the spirit and scope of the following claims.

Accordingly, other embodiments are within the scope of the following claims.

What is claimed is:

1. A towable sifting device; comprising:

a frame having open areas at top, bottom, and rear side;

a plurality of wheels coupled to the frame;

a first screen coupled to the frame, wherein the first screen has a grid to receive material for sifting;

a vibrating unit coupled to the first screen, wherein the vibrating unit is configured to vibrate the first screen such that reusable backfill material comprising small objects and dirt in the material passes through the screen and the top and bottom open areas of the frame and the large objects in the material fall off from the first screen at a first side of the sifting device; and a tow hitch configured for coupling to a vehicle for pulling the sifting device along a longitudinal axis of the sifting device parallel with a trench to leave a trail of the backfill material under and behind the sifting device through the rear side open area as the sifting device sifts the material while being towed.

2. The sifting device of claim 1, further comprising:

a guide coupled to the first screen, wherein the guide prevents the material from falling off from the first screen.

3. The sifting device of claim 1, further comprising:

a second screen disposed on the first screen, wherein the second screen allows fine objects to pass through the second screen onto a sand chute such that the fine objects fall off from the sand chute to a second side of the sifting device.

4. The sifting device of claim 3, wherein the sand chute is coupled to the frame with an angle at an opposite side of the first screen.

5. The sifting device of claim 1, wherein the vibrating unit is driven by a hydraulic pump.

6. The sifting device of claim 1, wherein the vibrating unit is driven by a belt connected to a pulley of a vehicle.

7. The sifting device of claim 1, further comprising:

a braking unit coupled to the tow hitch such that the braking unit prevents rotation of at least one of the plurality of the wheels when the sifting device is not pulled by a vehicle and the braking unit releases the at least one of the plurality of the wheels when the sifting device is pulled by the vehicle.

8. The sifting device of claim 1, wherein the first screen is coupled to the frame at an angle.

9. The sifting device of claim 1; wherein the first screen is movable such that the larger objects fall off from the first screen at a second side of the sifting device.

10. The sifting device of claim 1, wherein the sifting device drops the small objects and dirt onto the ground through the open area at the rear side as the sifting device is pulled by a vehicle.

11. The sifting device of claim 1, wherein the first screen is rotatable so that the large objects fall off from the first screen on a side of the sifting device that is opposite of the first side of the sifting device.

12. A method for separating large objects and small objects, the method comprising:

pouring material over a first screen coupled to a frame, wherein the first screen has a grid and the first screen and the frame form a sifting device;

vibrating the first screen with a vibration unit such that reusable backfill material comprising small objects and dirt passes through the first screen and the top and bottom open areas of the frame and larger objects fall off from the first screen at a first side of the sifting device; and moving the sifting device along a longitudinal axis of the sifting device parallel with a trench to leave a trail of the backfill material under and behind the sifting device through the rear side open area as the sifting device sifts the material while being towed.

13. The method of claim 12, further comprising:

pulling the sifting device by a vehicle such that the small objects and dirt drop to different regions through an open area at the rear side as the sifting device moves.

14. The method of claim 12, further comprising:

preventing the material from falling off from the first screen with a guide, wherein the guide is coupled to the first screen.

15. The method of claim 12, further comprising:

separating fine objects using a second screen, wherein the second screen allows fine objects to pass through the second screen onto a sand chute such that the fine objects fall off from the sand chute to a second side of the sifting device.

16. The method of claim 12, further comprising:

moving the first screen such that larger objects fall off from the first screen at a second side of the sifting device.

17. The method of claim 12, wherein the first screen is rotatable so that the large objects fall off from the first screen on a side of the sifting device that is opposite of the first side of the sifting device.

18. A towable sifting device, comprising:

a frame having open areas at top, bottom, and rear side;

a plurality of wheels coupled to the frame at a front and back of the frame;

a first screen coupled to the frame at a first angle, wherein the first screen has a grid to receive material for sifting;

a vibrating unit coupled to the first screen, wherein the vibrating unit is configured to vibrate the first screen such that reusable backfill material comprising small objects and dirt in the material passes through the screen and the top and bottom open areas of the frame and rubble comprising a remainder of the material not passing through the screen including large objects in the material fall off from the first screen at a first side of the sifting device; and a tow hitch configured towing of the sifting device along a longitudinal axis of the sifting device parallel with a trench to leave a first trail of the backfill material under and behind the sifting device through the rear side open area as the sifting device sifts the material and a second trail of the rubble on the first side of the sifting device while being towed as the material is sifted.

19. The towable sifting device according to claim 18, further including a second screen overlapping with the first screen, wherein the second screen passes sand comprising fine objects from the material onto a sand chute below the second screen such that the sand forms a third trail of the sand on the second side of the sifting device, which is opposite of the first side of the sifting device as the sifting device is towed as the material is sifted.

* * * * *